US008028481B2

(12) United States Patent
Deschenes

(10) Patent No.: US 8,028,481 B2
(45) Date of Patent: Oct. 4, 2011

(54) CAISSON CEILING SYSTEM

(76) Inventor: Herman Deschenes, Boischatel (CA)

( * ) Notice: Subject to any disclaimer, the term of this patent is extended or adjusted under 35 U.S.C. 154(b) by 151 days.

(21) Appl. No.: 12/471,326

(22) Filed: May 22, 2009

(65) Prior Publication Data

US 2010/0058692 A1 Mar. 11, 2010

Related U.S. Application Data

(60) Provisional application No. 61/094,875, filed on Sep. 6, 2008.

(51) Int. Cl.
*E04F 13/072* (2006.01)
*E04B 9/24* (2006.01)
*E04B 9/00* (2006.01)

(52) U.S. Cl. ..... 52/311.2; 52/314; 52/39; 52/460; 52/468; 52/469; 52/511; 52/506.05; 52/506.06; 52/506.01; 52/510

(58) Field of Classification Search ..... 52/460, 52/461, 464, 465, 468, 469, 506.01, 506.05, 52/506.07, 506.08, 510, 511, 39, 762, 745.21, 52/747.1, 747.2, 311.2, 314
See application file for complete search history.

(56) References Cited

U.S. PATENT DOCUMENTS

| | | | | | |
|---|---|---|---|---|---|
| 450,274 | A | * | 4/1891 | Wilson | 52/461 |
| 741,524 | A | * | 10/1903 | Miller | 52/506.05 |
| 764,948 | A | * | 7/1904 | Krebs | 52/464 |
| 985,367 | A | * | 2/1911 | Pitney | 52/313 |
| 1,502,732 | A | * | 7/1924 | Lydon | 52/506.08 |
| 1,866,742 | A | * | 7/1932 | Young | 52/145 |
| 2,285,631 | A | * | 6/1942 | Urbain | 411/461 |
| 2,401,587 | A | * | 6/1946 | Smith | 52/474 |
| 2,578,085 | A | * | 12/1951 | Perkins | 52/464 |
| 2,662,252 | A | * | 12/1953 | Styles | 52/282.3 |
| 2,825,099 | A | | 3/1958 | Simmons | |
| 3,251,164 | A | * | 5/1966 | Wright | 52/283 |
| 3,313,076 | A | * | 4/1967 | MacDonald | 52/781 |
| 3,470,666 | A | * | 10/1969 | Bobzin et al. | 52/506.08 |
| 3,685,238 | A | * | 8/1972 | Fisher et al. | 52/506.07 |
| 3,748,804 | A | * | 7/1973 | De George | 52/506.1 |
| 3,881,292 | A | * | 5/1975 | Porter | 52/461 |
| 4,367,616 | A | * | 1/1983 | Pearson | 52/664 |
| 4,452,021 | A | | 6/1984 | Anderson | |
| 4,722,161 | A | | 2/1988 | Young | |
| 4,736,559 | A | * | 4/1988 | Young | 52/313 |
| 4,841,709 | A | * | 6/1989 | Peterson et al. | 52/664 |
| 4,926,606 | A | | 5/1990 | Hanson | |
| 5,390,461 | A | | 2/1995 | Dwyer | |
| 5,623,800 | A | * | 4/1997 | Shinkosky | 52/468 |
| 6,308,485 | B1 | * | 10/2001 | Blumenthal | 52/468 |
| 2004/0065036 | A1 | * | 4/2004 | Capozzo | 52/506.03 |
| 2005/0102932 | A1 | * | 5/2005 | MacKey et al. | 52/204.1 |
| 2005/0210801 | A1 | * | 9/2005 | Schoolcraft | 52/506.01 |

FOREIGN PATENT DOCUMENTS

| | | | |
|---|---|---|---|
| DE | 36 08 365 | A1 * | 8/1987 |
| JP | 1-125447 | * | 5/1989 |
| WO | WO 2005/102091 | A1 | 11/2005 |

* cited by examiner

*Primary Examiner* — Robert Canfield

(57) ABSTRACT

A caisson system having an attachment plate fastened to ceiling joists; compressible spacers to allow for the attachment plate to be perfectly straight; caisson frames consisting of a combination of a pair of length planks and a pair of width planks to create a generally rectangular structure; length cover planks and width cover planks, along with tiles to finish the caisson frames.

9 Claims, 6 Drawing Sheets

FIG. 6a
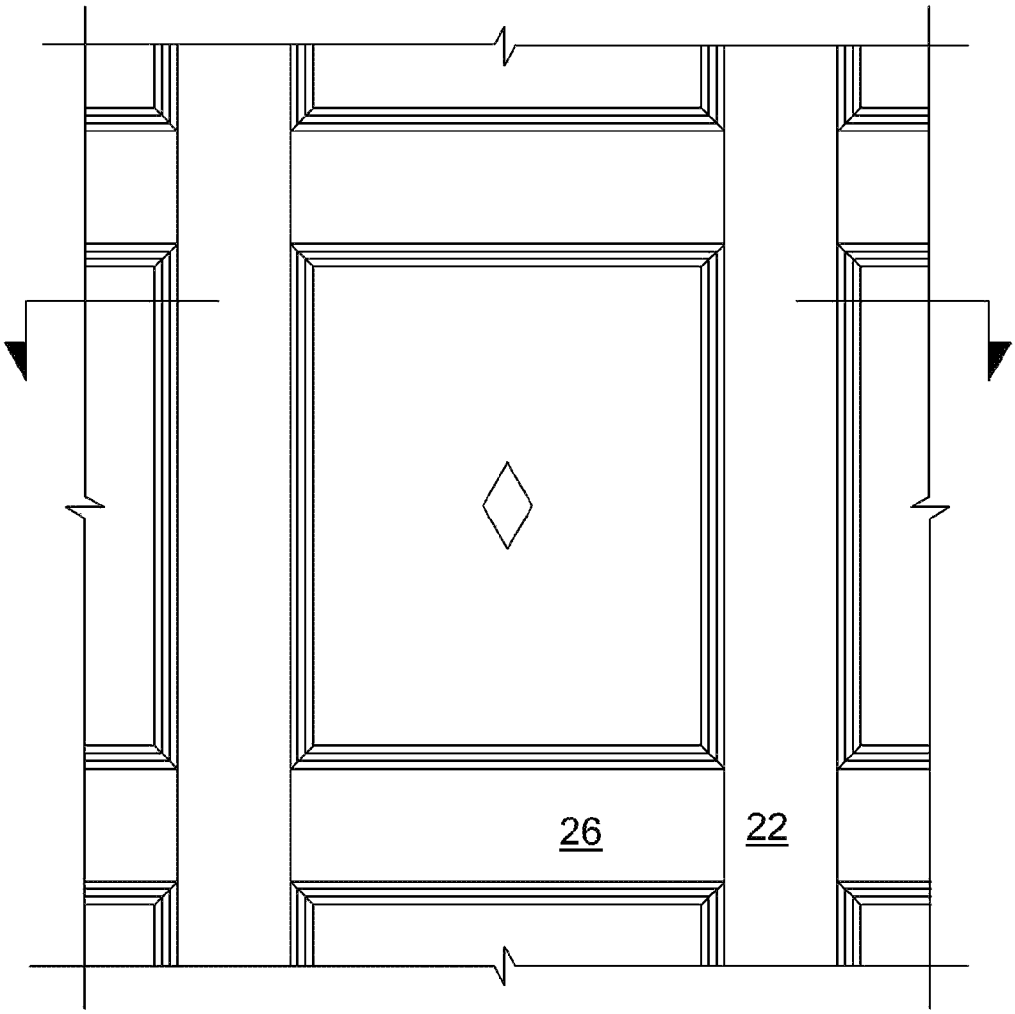
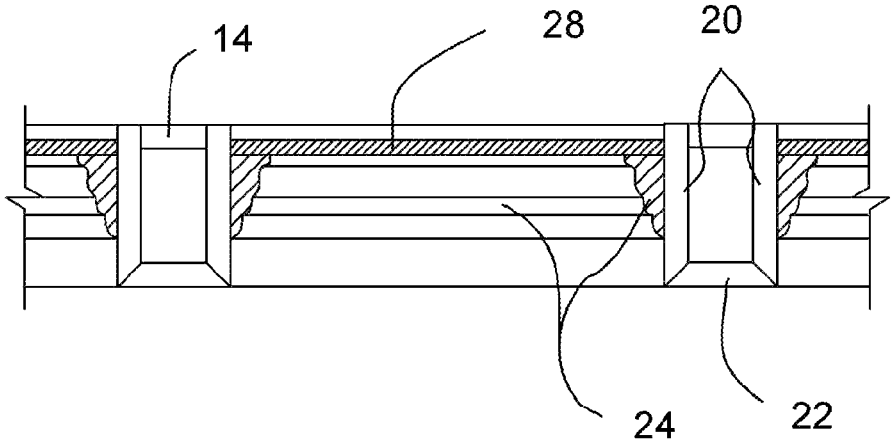
FIG. 6b

CAISSON CEILING SYSTEM

This application claims priority based on provisional application 61094875 filed Sep. 6, 2008

FIELD OF THE INVENTION

The present invention relates generally to building materials but more particularly to a system for making a caisson ceiling.

BACKGROUND OF THE INVENTION

Caisson ceiling, also referred to as coffer ceilings are square or polygonal ornamental sunken panel used in a series as decoration for a ceiling or vault. Caisson ceilings are often found in luxury homes. Because they require expert craftsmanship and takes a lot of time to assemble, they are very costly and that is why they are only found in luxury homes. There exist a variety of modular systems borrowing their features and method of installation from suspended tile ceilings such as those found in office buildings. There are other systems using cheap lightweight molded plastic or metal modules that are glued or mechanically fastened to the ceiling.

However, none of those systems use real wood that is easily assembled on site so as to provide for a quick installation.

SUMMARY OF THE INVENTION

In view of the foregoing disadvantages inherent in the known devices now present in the prior art, the present invention, which will be described subsequently in greater detail, is to provide objects and advantages which are:

To provide for a ready made set of modules or at least ready to assemble modules that install quickly by way of a simple system of planks that allow for easy attachment. Low production costs as well as reduced labor costs make this system affordable.

To attain these ends, the present invention generally comprises a series of precut pieces of natural wood or engineered wood product that gives the appearance of real wood.

The system consists in a plurality of fixation modules fastened between at least two attachment planks in a one is to many configuration whereby the at least two attachment planks are further fastened to a ceiling and whereby the at least two attachment planks include a predetermined parallel and equidistant separation between each other; and a plurality of projecting elements extending laterally from a plurality of sideboards of the plurality of fixation modules for driving mechanical fasteners through the at least two attachment planks, whereby the plurality of sideboards is included in the plurality of fixation modules.

Moreover, the caisson ceiling system has each of the plurality of sideboards further comprising a notch for frictionally inserting into each of the at least two attachment planks to thereby enable each of the plurality of sideboards to make a contact with the ceiling and a side of each of the at least two attachment planks.

The plurality of projecting elements are located to make a contact with a surface of each of the at least two attachment planks whereby the surface is a lower surface facing a floor.

A covering plank is attached to at least one of the plurality of sideboards, wherein the covering plank is configured to cover a central portion of the plurality of fixation modules while being disposed opposite to the at least two attachment planks.

The covering plank is attached to at least one of the plurality of sideboards, wherein the covering plank is configured to cover the central portion of the plurality of fixation modules while being disposed opposite to the at least two attachment planks.

The caisson ceiling system has each of the plurality of fixation modules comprising:

a plurality of sideboards;

a plurality of frames disposed between the plurality of sideboards along a length of the sideboards, wherein each of the plurality of frames comprising a panel; and a plurality of end boards coupled to a plurality of frame spacer planks for creating a separation among the plurality of frames along the length of the sideboards.

Furthermore, the frames and panels are regular geometrical constructions, further comprising at least one of: a rectangular construction; a square construction; a pentagonal construction; a triangular construction; a hexagonal construction; and an octagonal construction.

A method for assembling a caisson ceiling system, comprising: placing one panel each in a plurality of frames along a length of a plurality of sideboards in a linear enclosing configuration to generate a fixation module structure; mechanically fixing a plurality of attachment planks to a ceiling; coupling the fixation module structure to at least one attachment planks of the plurality of attachment planks; mechanically attaching a finishing plank at a central position of the fixation module structure through the plurality of sideboards, whereby the finishing plank is included in the plurality of attachment planks; a step of driving mechanical fasteners through and into the plurality of attachment planks through a plurality of projecting elements to thereby attach the fixation module structure to the ceiling.

In some variations in the method of installation, the assembling of the fixation module structures is in a non linear staggered configuration.

Also, the finishing plank more than a length of the fixation module structure to enable a stronger support for the caisson ceiling system.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

BRIEF DESCRIPTION OF THE DRAWINGS

FIGS. 6*a-b* Plan and side cutaway views, respectively, of a panel installed in a module.

DETAILED DESCRIPTION OF THE PREFERRED EMBODIMENT

Figure 1:
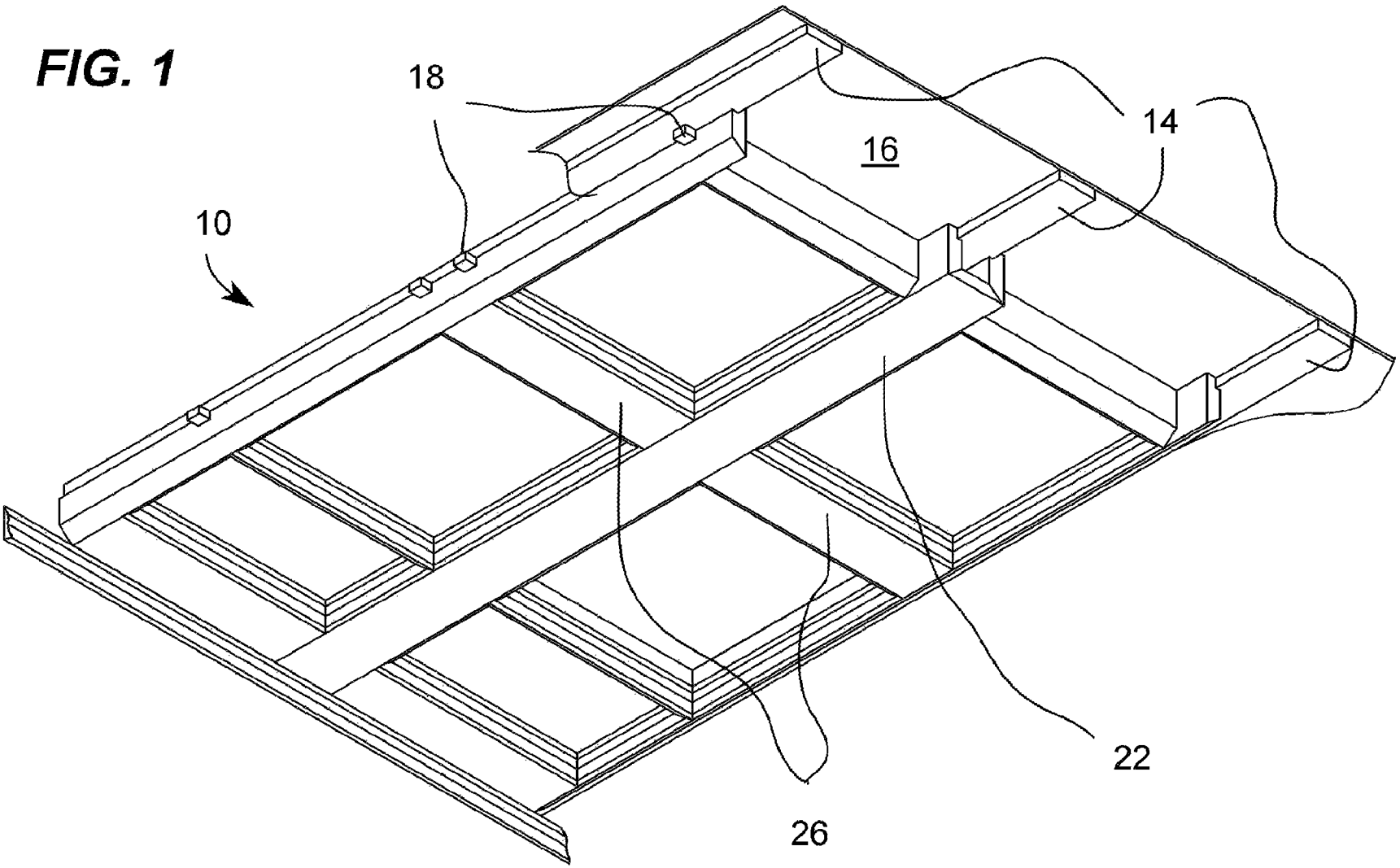
FIG. 1 Perspective view of the invention as installed on a ceiling.

A caisson system for ceiling (10) consists in at least one fixation fixation module (12) which is itself made from parts which will be described later.

Each fixation module (12) is mechanically fastened to an attachment plank (14), which is itself mechanically fastened to a ceiling (16) which is defined here as either exposed support beams (joists, steel beams, etc) or finished dry wall ceiling, as commonly found in North American constructions. Each attachment plank (14) is set parallel to the walls, or perpendicular to the walls, depending on how you look at it, suffice to say that each attachment plank (14) has to be at a preset distance and parallel to the preceding one.

For some installations, it may be necessary to use wedges to insure that the attachment planks (14) are straight and do not follow the irregularities that are sometimes found in old wooden joist construction wherein spacers and wedges are necessary to achieve perfect adjustments so that the attachment plank (14) is straight. These wedging techniques are well known in the construction and carpentry trade and need not be further discussed herein.

Once the attachment planks (14) are affixed, the modules (12) are fitted between two attachment planks (14) like wagons on tracks. This is why it is important that each attachment plank (14) be parallel and equidistant from the preceding one (or the one that follows for that matter).

A plurality of projecting elements (18) extending laterally from side boards (20), which form part of each of the fixation module (12), and are used for driving mechanical fasteners through and into the attachment planks (14) so as to affix the modules (12) onto the ceiling (16). Moreover, the sideboards have a notch (19) which is frictionally inserted into the attachment plank (14) so that the side boards make contact with the ceiling (16) and the side of the attachment plank (14).

Figure 2:
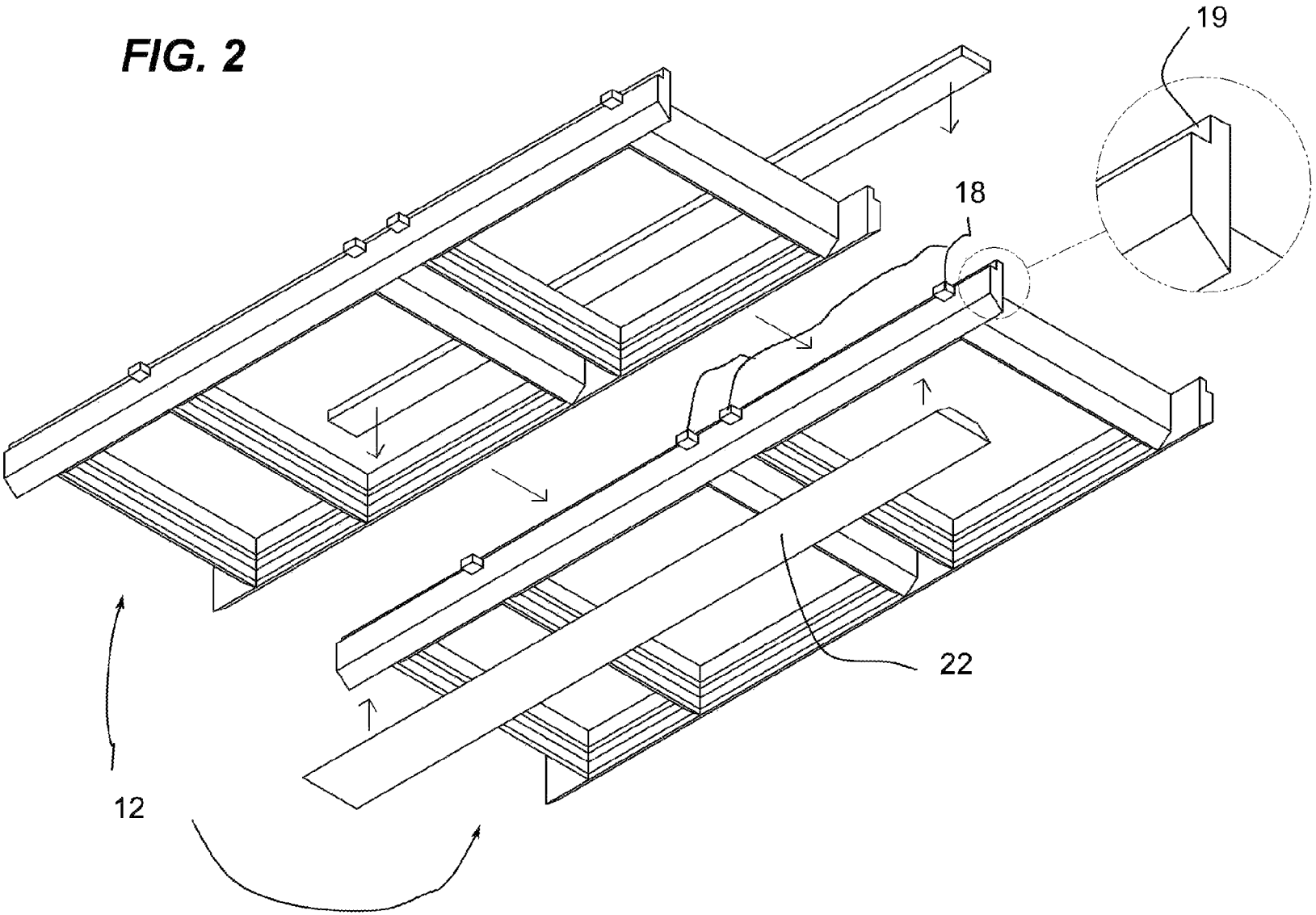
FIG. 2 Perspective view showing modules during the installation process.

The projecting elements (18) are so located in relation to the notch (19) that they make contact with the face of the attachment plank (14). Once a pair of modules (12) is installed, a covering plank (22) is mechanically attached to the side boards (20) of adjoining modules (12) (as per FIG. 2).

Figure 3:
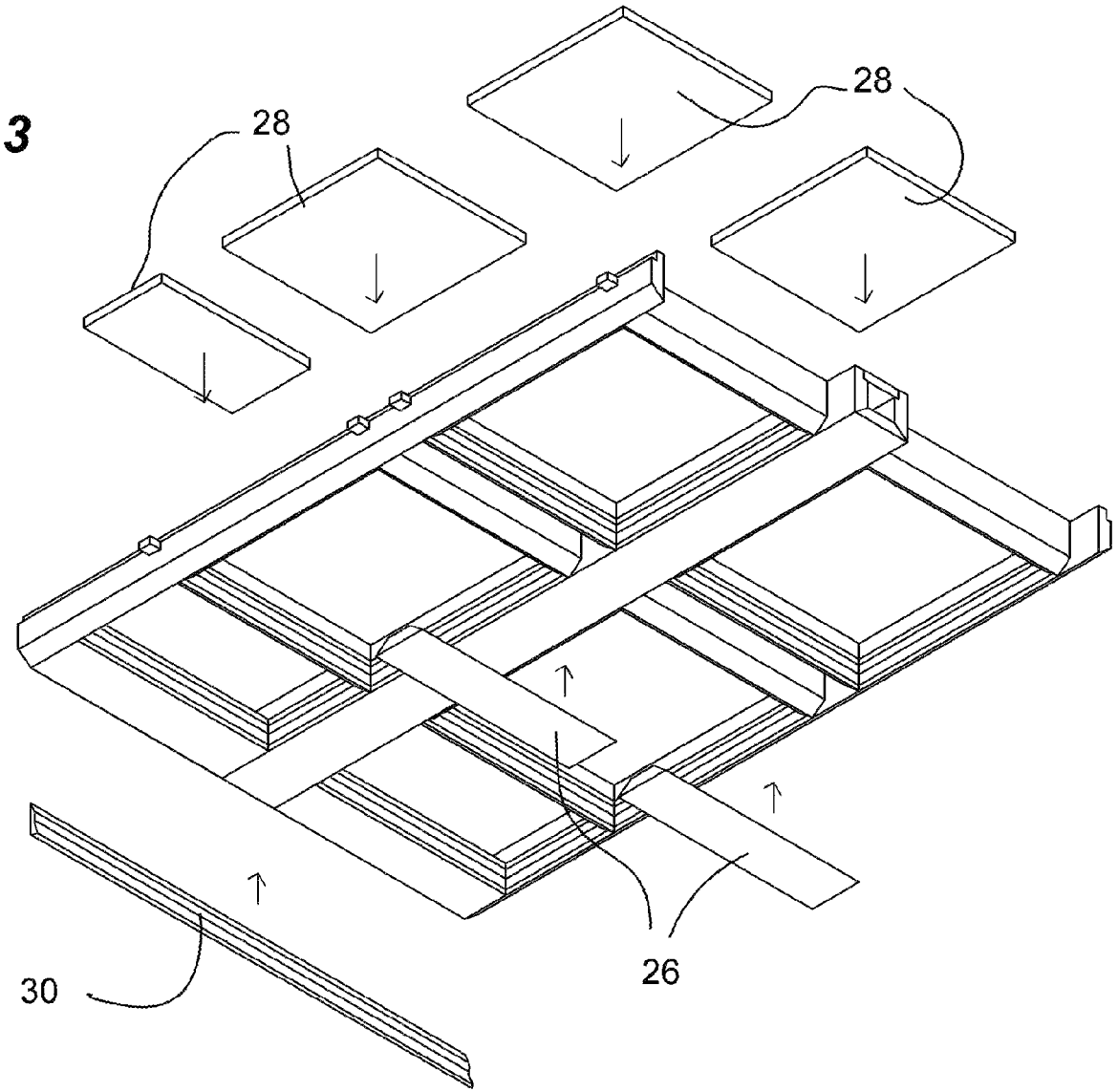
FIG. 3 Exploded view showing the various components of a pair of cojoined modules.
Figure 4:
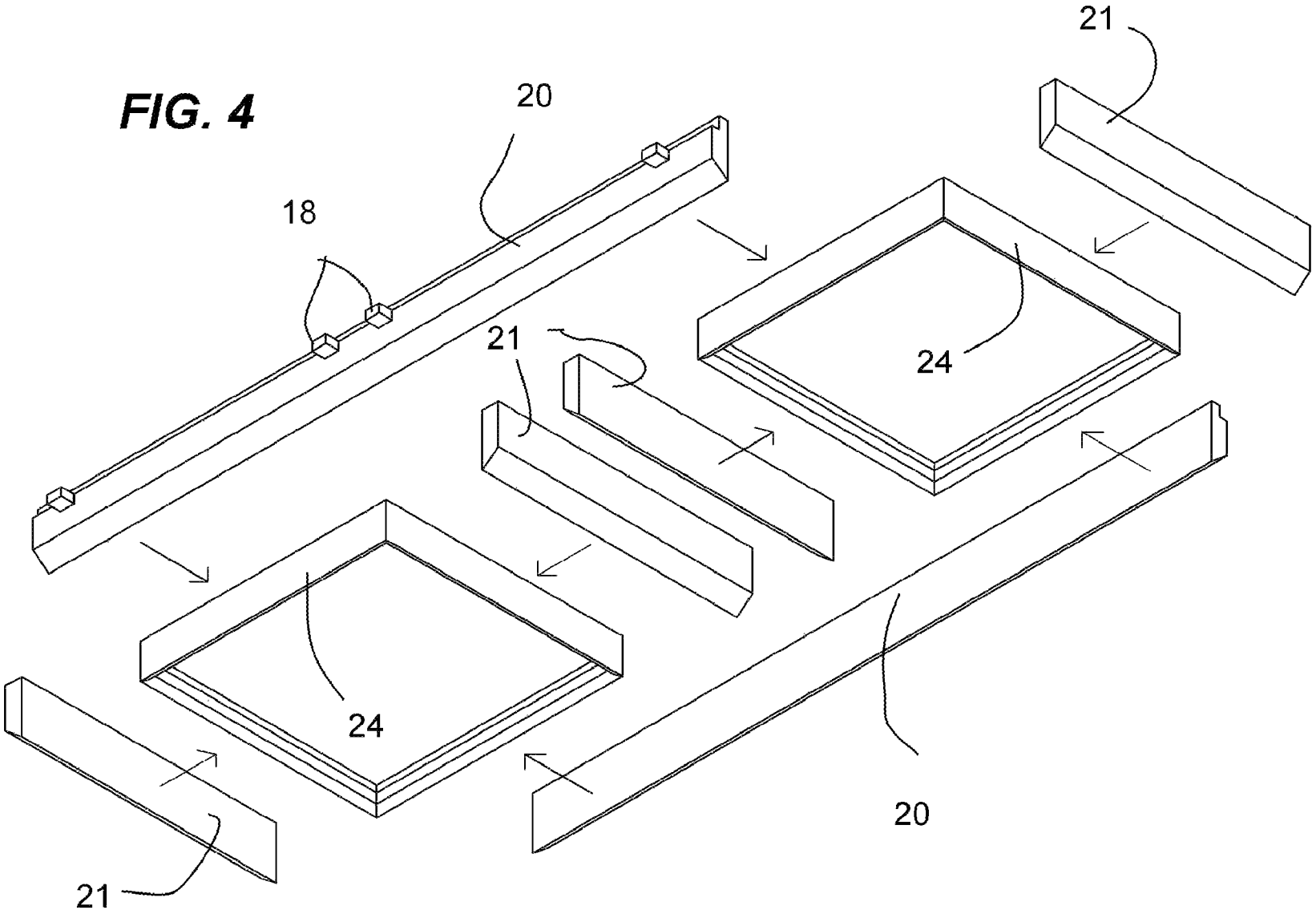
FIG. 4 Exploded view showing the various components of a module before assembly.
Figure 5:
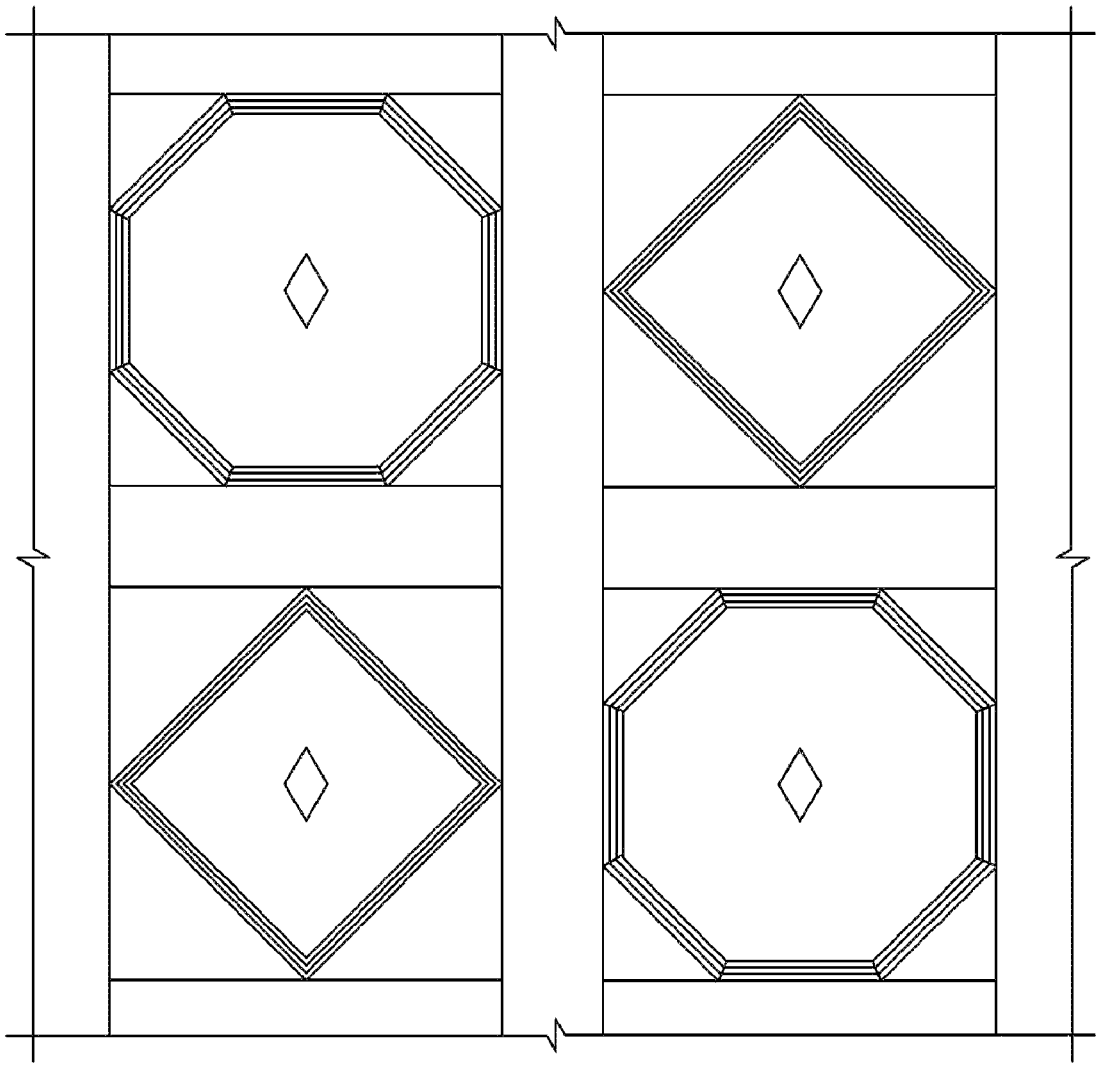
FIG. 5 Plan view of examples of panel motifs.

FIG. 4 shows an exploded view of a fixation module (12) with its side boards (20) frames (24), end boards (21) used in combination with frame spacer (26) to separate each frame (24) along the length of the side boards (20). Encased within each frames (24) are panels (28) which come in a variety of models and shapes, as 20 shown in FIG. 5. It is to be understood that the frames (24) are not necessarily square in shape, they can be rectangular or any other geometric shape, providing that the frame spacer planks (26) have a shape that fills in the empty space of, for example, an octagonal frame. But, as can be seen in FIG. 5, the panels (28) can be square or rectangular while the pattern on it can describe a geometric shape. This is the preferred embodiment since it uses a limited number of variations in the shapes of the frame spacer planks (26). Preferably, a finishing trim (30) can cover the perimeter of the caisson system for ceiling (10) as per FIG. 3.

The caisson system for ceiling (10) is assembled according to the following steps:

The modules (12) are assembled either off site or on site by by placing at least one frame (24), when there is more than one frame (24), when there is more than one frame 924), a pair of end boards (21), spaced by a spacer covering planks (26) are used between two frames (24). Alternatively, two frames (24) can be cojoined. The aforementioned components are mechanically attached together and the panels (28) are placed inside the frames. Alternatively, the panels can be placed at the end of the installation.

Attachment planks (14) are mechanically attached to the ceiling (16) and the modules (12) are fitted between two attachment planks (14). A plurality of projecting elements (18) extending laterally from the side boards (20) of each of the fixation module (12) are used for driving mechanical fasteners through and into the attachment planks (14) so as to affix the modules (12) onto the ceiling (16). Once at least two modules (12) are installed side to side, a covering plank (22) is mechanically attached to the side boards (20) of adjoining modules (12).

The modules need not be set side by side as shown but rather staggered like one would lay a brick wall. The covering plank (22) can exceed the length of the modules (12) so as to span more modules and thus create a stronger caisson (10) by not having all joints lined up.

If not already installed, the panels (28) can be installed at this point. For decorative purposes, some panels (28) within the caisson system for ceiling (10) can be replaced with a ventilation grille or a translucent module hiding a light source. In other words, a ventilation grille or a translucent module can occupy the space of a panel within a frame (24) in lieu of a panel. (28).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A caisson ceiling system, comprising:

a plurality of fixation modules fastened between at least two attachment planks in a configuration whereby the at least two attachment planks are further fastened to a ceiling and whereby the at least two attachment planks include a predetermined parallel and equidistant separation between each other; and a plurality of projecting elements extending laterally from a plurality of sideboards of the plurality of fixation modules for driving mechanical fasteners through the at least two attachment planks, whereby the plurality of sideboards is included in the plurality of fixation modules.

2. The caisson ceiling system of claim 1, wherein each of the plurality of sideboards further comprising a notch frictionally inserted between each of the at least two attachment planks to thereby enable each of the plurality of sideboards to make a contact with the ceiling and a side of each of the at least two attachment planks.

3. The caisson ceiling system of claim 1, wherein the plurality of projecting elements are located to make a contact with a surface of each of the at least two attachment planks whereby the surface is a lower surface facing a floor.

4. The caisson ceiling system of claim 2, wherein the plurality of projecting elements are located to make a contact with a surface of each of the at least two attachment planks whereby the surface is a lower surface facing a floor.

5. The caisson ceiling system of claim 1, wherein a covering plank is attached to at least one of the plurality of sideboards, wherein the covering plank is configured to span between two adjacent sideboards.

6. The caisson ceiling system of claim 2, wherein a covering plank is attached to at least one of the plurality of sideboards wherein the covering plank is configured to cover the central portion of the plurality of fixation modules while being disposed opposite to the at least two attachment planks.

7. The caisson ceiling system of claim 3, wherein a covering plank is attached to at least one of the plurality of sideboards, wherein the covering plank unit is configured to cover the central portion of the plurality of fixation modules while being disposed opposite the at least two attachment planks.

8. The caisson ceiling system of claim 1, wherein each of the plurality of fixation modules comprising: a plurality of sideboards;

a plurality of frames disposed between the plurality of sideboards along a length of the sideboards, wherein each of the plurality of frames comprising a panel; and a plurality of end boards coupled to a plurality of frame spacer planks for creating a separation among the plurality of frames along the length of the sideboards.

9. The caisson ceiling system of claim 8, wherein both the plurality of frames and the plurality of panels are regular geometrical constructions, further comprising at least one of:

a rectangular construction;

a square construction;

a pentagonal construction;

a triangular construction;

a hexagonal construction; and an octagonal construction.

* * * * *